US005255635A

United States Patent [19]

Schäfer et al.

[11] Patent Number: 5,255,635

[45] Date of Patent: Oct. 26, 1993

[54] EVAPORATIVE COOLING SYSTEM FOR AN INTERNAL COMBUSTION ENGINE HAVING A COOLANT EQUALIZING TANK

[75] Inventors: Hans-Jürgen Schäfer, Braunschweig; Herbert Schäpertöns, Gifhorn; Bodo Scheibner, Wolfsburg, all of Fed. Rep. of Germany

[73] Assignee: Volkswagen AG, Wolfsburg, Fed. Rep. of Germany

[21] Appl. No.: 803,348

[22] Filed: Dec. 4, 1991

[30] Foreign Application Priority Data

Dec. 17, 1990 [DE] Fed. Rep. of Germany ..... 4040324

[51] Int. Cl.[5] ..... F01P 9/02

[52] U.S. Cl. ..... 123/41.2; 123/41.5

[58] Field of Search ..... 123/41.2, 41.21, 41.5, 123/41.15

[56] References Cited

U.S. PATENT DOCUMENTS

| | | | |
|---|---|---|---|
| 4,648,356 | 3/1987 | Hayashi | 123/41.21 |
| 5,092,282 | 3/1992 | Dänekas et al. | 123/41.21 |
| 5,176,112 | 1/1993 | Sausner et al. | 123/41.21 |

FOREIGN PATENT DOCUMENTS

| | | | |
|---|---|---|---|
| 3339717 | 1/1990 | Fed. Rep. of Germany . | |
| 1252221 | 12/1960 | France | 123/41.15 |

*Primary Examiner*—Noah P. Kamen

*Attorney, Agent, or Firm*—Brumbaugh, Graves, Donohue & Raymond

[57] ABSTRACT

An evaporative cooling system for an internal combustion engine has an equalizing tank which is sealed from the atmosphere and divided by a yielding wall into an air-equalizing chamber and a coolant chamber and which has a low flow-resistance connection to the suction side of a condensate pump.

3 Claims, 1 Drawing Sheet

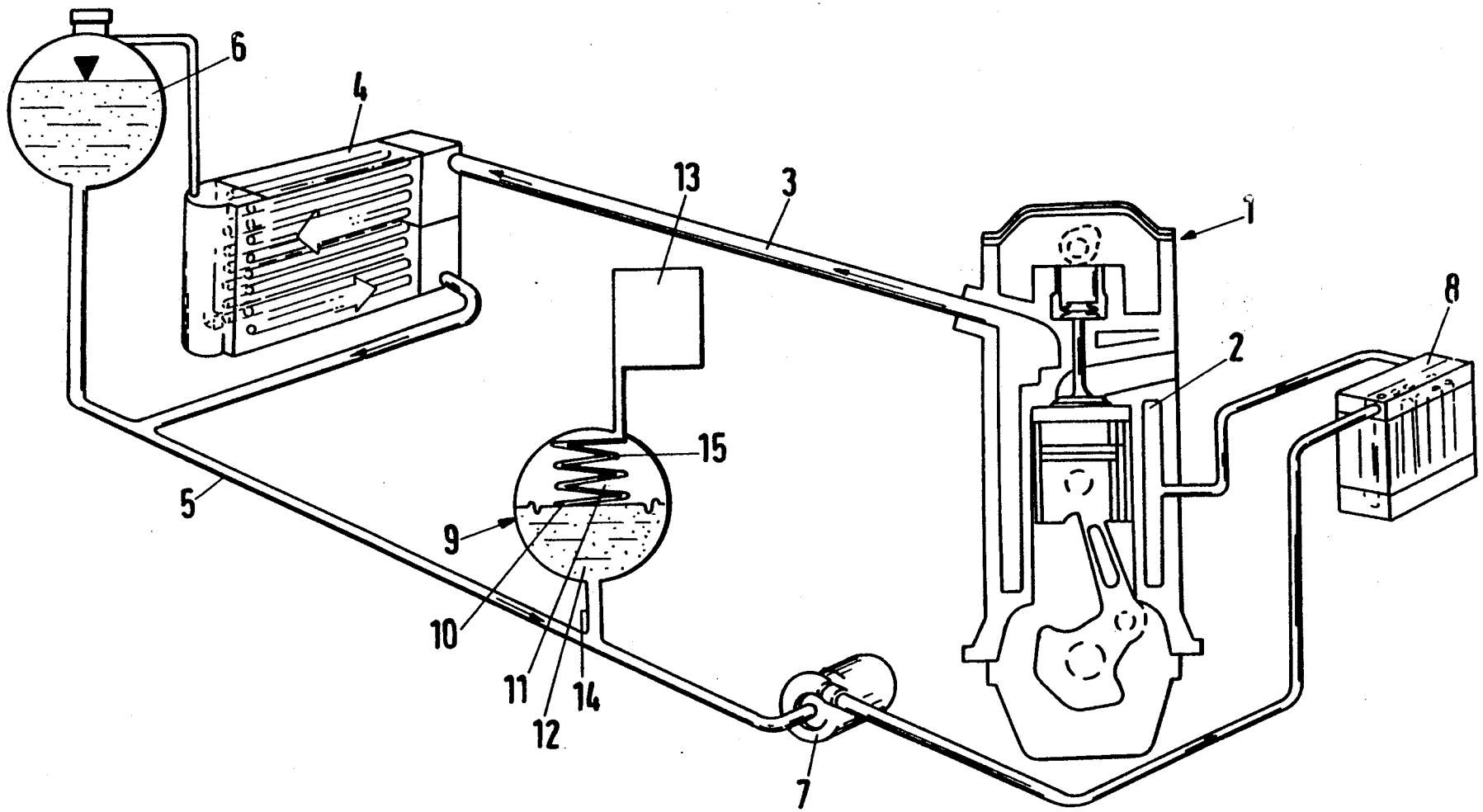
8
1
2
3
13
15
14
12
11
10
9
7
4
6
5

EVAPORATIVE COOLING SYSTEM FOR AN INTERNAL COMBUSTION ENGINE HAVING A COOLANT EQUALIZING TANK

BACKGROUND OF THE INVENTION

This invention relates to evaporative cooling systems for internal combustion engines which include a coolant equalizing tank.

Evaporative cooling systems having coolant equalizing tanks are disclosed, for example, in German Offenlegungsschrift No. 33 39 717 and U.S. Pat. No. 4,648,356. In those systems, an air chamber in the equalizing tank is open to the atmosphere, and the coolant chamber of the equalizing tank, which is separated from the air chamber by a yielding wall, serves to receive air and/or coolant vapor from the coolant system.

SUMMARY OF THE INVENTION

Accordingly, it is an object of the present invention to provide an evaporative cooling system with an equalizing tank which overcomes the disadvantages of the prior art.

Another object of the invention is to provide an evaporative cooling system of this type which is arranged to accommodate dynamic variations in the volume of coolant vapor resulting from variations in engine load rapidly.

These and other objects of the invention are attained by providing an evaporative cooling system having a condensate pump in a condensate line leading from a condenser to the engine and an equalizing tank which has a yielding wall between air and coolant chambers and which has a low flowresistance communication with the suction side of the condensate pump in which the air chamber is sealed from the atmosphere.

Because the connection between the coolant chamber of the equalizing tank and the suction side of the condensate pump has a low flow resistance, the pump is able to deliver rapidly the quantity of liquid coolant required from time to time, depending upon variations in engine load, to the cooling chambers of the internal combustion engine with no great expenditure of energy. At the same time, the supply of coolant is unaffected by the ambient atmospheric pressure, which may vary depending on whether the internal combustion engine is operating at high or low altitude, because the air volume in the rigid housing of the equalizing tank is sealed from the atmosphere.

The yielding wall in the equalizing tank may consist of a piston or the tank may alternatively contain a conventional elastic membrane. If an elastic membrane is used, it is expedient to bias the membrane toward the coolant chamber with a compression spring disposed in the air chamber.

BRIEF DESCRIPTION OF THE DRAWING

Further objects and advantages of the invention will be apparent from a reading of the following description in conjunction with the accompanying drawing which is a perspective schematic diagram, partly in section, showing a representative embodiment of an evaporative cooling system arranged according to the invention.

DESCRIPTION OF PREFERRED EMBODIMENT

In the typical embodiment of the invention shown in the drawing, a reciprocating-piston internal combustion engine 1 of conventional design has a plurality of cooling chambers or passages 2 in which a circulated coolant is vaporized by engine heat. The coolant vapor generated in the cooling chambers 2 passes from the engine through a vapor line 3 into a condenser 4 from which condensed coolant is supplied to a condensate line 5. The condenser 4 also serves as a cooler for any liquid coolant received through the line 3. A coolant supply tank 6 is connected to the condensate line 5. It will be understood that a conventional thermostat-controlled condenser bypass line (not shown) may be arranged to bypass coolant around the condenser 4 when the engine is warming up so that the engine will reach its normal operating temperature relatively quickly.

A condensate pump 7, driven either directly from the engine or by an electric motor, is provided in the condensate line 5. If the pump is driven by an electric motor, it can operate independently of the speed of the engine 1. The pump transfers comparatively cool liquid coolant through the condensate line 5 to the cooling chambers 2 of the engine, depending upon eh vaporization of coolant in the engine and therefore upon the engine load. In the illustrated embodiment, the coolant passes through a vehicle heating system 8 between the pump 7 and the engine.

Because the volume of coolant vapor in the cooling system is subject to large fluctuations, a coolant equalizing tank 9, connected to the condensate line 5, is partitioned by a membrane 10 into an air chamber 11 and a coolant chamber 12. In the illustrated embodiment, an additional air chamber 13 is connected to the air chamber 11, which may also contain a mechanical spring 15.

In order to enable the condensate pump 7 to respond quickly to changes in the coolant requirements of the engine 1, the coolant chamber 12 is connected by a line 14 having a large flow cross-section, and hence low flow resistance, to the suction side of the coolant pump 7 following the shortest possible route. Because the air chambers 11 and 13 of the equalizing tank 9 are sealed for the atmosphere, the condensate pump 7 can vary its delivery as a function of the then load on the engine 1 at any ambient atmospheric pressure.

With this arrangement, the invention provides a simple construction for accommodating dynamic variations in the volume of coolant vapor resulting from variations in the load on the internal combustion engine being cooled.

Although the invention has been described herein with reference to a specific embodiment, many modifications and variations therein will readily occur to those skilled in the art. Accordingly, all such variations and modifications are included within the intended scope of the invention.

We claim:

1. An evaporative cooling system for an internal combustion engine comprising an engine, a condenser for vaporized coolant, a condensate line to supply coolant from the condenser to the engine, a condensate pump int eh condensate line, and a rigid coolant equalizing tank divided by a yielding wall into a coolant chamber and an air chamber, wherein the equalizing tank is connected to the suction side of the condensate pump and the air chamber is sealed from the atmosphere.

2. An evaporative cooling system according to claim 1 including a mechanical spring in the air chamber acting upon the yielding wall.

3. An evaporative cooling system according to claim 1 wherein the yielding wall includes an elastic membrane.

* * * * *